United States Patent [19]

Mohr

[11] Patent Number: 4,604,341

[45] Date of Patent: Aug. 5, 1986

[54] PROCESS FOR THE ONE-STAGE ANODIC OXIDATION OF ALUMINUM BASES FOR OFFSET PRINTING PLATES AND PRODUCT THEREOF

[75] Inventor: Dieter Mohr, Schlangenbad, Fed. Rep. of Germany

[73] Assignee: Hoechst Aktiengesellschaft, Frankfurt am Main, Fed. Rep. of Germany

[21] Appl. No.: 634,588

[22] Filed: Jul. 26, 1984

[30] Foreign Application Priority Data

Aug. 3, 1983 [DE] Fed. Rep. of Germany ..... 3328049

[51] Int. Cl.[4] ..... C25D 11/06; B41N 1/04; B41C 1/10

[52] U.S. Cl. ..... 430/278; 101/456; 101/463.1; 204/27; 204/33; 204/38.3; 204/58; 428/469

[58] Field of Search ..... 204/27, 28, 29, 33, 204/38 A, 58; 101/456, 463.1; 430/278; 428/469

[56] References Cited

U.S. PATENT DOCUMENTS

| | | | |
|---|---|---|---|
| 3,511,661 | 5/1970 | Rauner et al. | 430/278 |
| 3,522,166 | 7/1970 | Jones | 204/206 |
| 3,594,289 | 7/1971 | Watkinson et al. | 204/38.3 |
| 3,836,437 | 9/1974 | Osada et al. | 204/17 |
| 3,844,908 | 10/1974 | Matsuo et al. | 204/35.1 |
| 3,960,676 | 6/1976 | Miyosawa et al. | 204/38.3 |
| 4,188,270 | 2/1980 | Kataoka | 204/42 |
| 4,211,619 | 7/1980 | Usbeck | 204/33 |
| 4,399,021 | 8/1983 | Gillich | 204/38.3 |

OTHER PUBLICATIONS

Galvanotechnik, vol. 66, No. 5, p. 436 (1975).

*Primary Examiner*—John F. Niebling
*Assistant Examiner*—William T. Leader
*Attorney, Agent, or Firm*—Schwartz, Jeffery, Schwaab, Mack, Blumenthal & Evans

[57] ABSTRACT

A process is disclosed for the production of bases for offset printing plates in the form of sheets, foils or webs made of roughened aluminum or one of its alloys, which is carried out in an anodic oxidation stage, i.e. in an aqueous electrolyte which contains phosphorus-containing anions. In the procedure, an electrolyte containing dissolved phosphoroxo anions, with the exception of aqueous $H_3PO_4$, is employed, and the treatment is carried out for a period of about 1 to 90 seconds, at a voltage between about 10 and 100 volts and at a temperature of about 10° to 80° C. The electrolyte is, in particular, a salt of an oxyacid of phosphorus, such as $Na_3PO_4$ or $K_3PO_4$. Hydrophilization of the base can be carried out additionally after the anodic oxidation. Also disclosed is a base material produced according to the process and an offset printing plate which includes the base material.

13 Claims, No Drawings

PROCESS FOR THE ONE-STAGE ANODIC OXIDATION OF ALUMINUM BASES FOR OFFSET PRINTING PLATES AND PRODUCT THEREOF

BACKGROUND OF THE INVENTION

The present invention relates to a one-stage anodic oxidation process for aluminum which is employed as a base for offset printing plates, the base resulting from this process and the offset printing plate itself.

Bases for offset printing plates are provided, either directly by the user or by the manufacturer of precoated printing plates, with a radiation-sensitive or photosensitive layer (reproduction layer) on one or both sides, with the aid of which layer a printable image is produced by photomechanical means. After production of a printing form from the printing plate, the base carries the image areas which convey ink during subsequent printing and, in the areas which are image-free during subsequent printing (non-image areas), also forms the hydrophilic image background for the lithographic printing process.

Bases for reproduction layers for the production of offset printing plates therefore have to meet the following requirements:

- The areas of the radiation-sensitive layer which are relatively more soluble after exposure must be capable of being readily removed from the base without leaving a residue to produce the hydrophilic non-image areas, this being done without the developer attacking the base to any great extent.
- The base bared in the non-image areas must have a great affinity for water, i.e., must be very hydrophilic, in order, in the lithographic printing process, to take up water rapidly and permanently and to have a sufficiently repellent action toward the fatty printing ink.
- The adhesion of the photosensitive layer before exposure, and of the printing areas of the layer after exposure, must be adequate.
- The base should possess good mechanical stability, for example to abrasion, and good chemical resistance, in particular to alkaline media.

A particularly frequently used starting material for such bases is aluminum, the surface of which is roughened by conventional methods, for example, by dry-brushing, wet-brushing, sand blasting, chemical treatment and/or electrochemical treatment. To increase the abrasion-resistance, electrochemically roughened substrates, in particular, are subjected to an anodizing step to build up a thin oxide layer. These anodic oxidation processes are usually carried out in electrolytes such as $H_2SO_4$, $H_3PO_4$, $H_2C_2O_4$, $H_3BO_3$, amidosulfonic acid, sulfosuccinic acid, sulfosalicylic acid or mixtures of these. The oxide layers produced in these electrolytes or mixtures of electrolytes differ in structure, layer thickness and resistance to chemicals. In practice, in offset printing plate production, an aqueous $H_2SO_4$ or $H_3PO_4$ solution is particularly employed. With regard to $H_2SO_4$-containing electrolytes, reference may be made to, for example, U.S. Pat. No. 4,211,619 and the prior art mentioned therein.

Aluminum oxide layers produced in aqueous $H_2SO_4$-containing electrolytes are amorphous and, when used in offset printing plates, usually have a weight per unit area of about 0.5 to 10 g/m$^2$, corresponding to a layer thickness of about 0.15 to 3.0 $\mu$m. The disadvantage of using such an anodically oxidized base for offset printing plates is the fact that the oxide layers produced in $H_2SO_4$ electrolytes have a relatively low resistance to alkaline solutions as used to an increasing extent in, for example, the processing of presensitized offset printing plates, preferably in modern developer solutions for irradiated negative-working or, in particular, positive-working radiation-sensitive layers.

The anodic oxidation of aluminum in aqueous electrolytes containing phosphorus oxyacids or phosphates is likewise known per se:

U.S. Pat. No. 3,511,661 describes a process for the production of a lithographic printing plate, in which the aluminum base is oxidized anodically at a temperature of at least 17° C. in an at least 10% strength aqueous $H_3PO_4$ solution, until the aluminum oxide layer has a thickness of at least 50 nm.

U.S. Pat. No. 3,594,289 discloses a process in which a printing plate base made of aluminum is oxidized anodically in a 50% strength aqueous $H_3PO_4$ solution at a current density of 0.5 to 2.0 A/dm$^2$ and at a temperature of 15° to 40° C.

The process for the anodic oxidation of aluminum bases, in particular for printing plates, according to U.S. Pat. No. 3,836,437 is carried out in a 5 to 50% strength aqueous $Na_3PO_4$ solution at a temperature of 20° to 40° C. and a current density of 0.8 to 3.0 A/dm$^2$ and for a period of 3 to 10 minutes. The aluminum oxide layer thus produced should have a weight of 10 to 200 mg/m$^2$. The aluminum can also be mechanically or chemically roughened or etched beforehand.

The aqueous bath for the electrolytic treatment of aluminum which is to be subsequently coated with a water-soluble or water-dispersible substance contains, according to U.S. Pat. No. 3,960,676, 5 to 45% of silicates, 1 to 2.5% of permanganates, or borates, phosphates, chromates, molybdates or vanadates in an amount from 1% to saturation. Preparation of bases for printing plates is not mentioned, nor is prior roughening of the material.

British Pat. No. 1,587,260 discloses a base for printing plates which carries an oxide layer which is produced by anodic oxidation of aluminum in an aqueous solution of $H_3PO_3$ or a mixture of $H_2SO_4$ and $H_3PO_3$. This relatively porous oxide layer is then covered with a second oxide film of the "barrier layer" type, which can be formed, for example, by anodic oxidation in aqueous solutions containing boric acid, tartaric acid or borates. Both the first stage (Example 3, 5 min) and the second stage (Example 3, 2 min) are carried out very slowly, and furthermore, the second stage is carried out at a relatively high temperature (80°).

It is true that an oxide layer produced in $H_3PO_4$ is often more resistant to alkaline media than is an oxide layer produced in an electrolyte based on $H_2SO_4$ solution. This oxide layer while having some other advantages, such as a paler surface, better water/ink balance or less adsorption of dyes ("staining") in the non-image areas), also possesses significant disadvantages. In a modern conveyor line for the production of printing plate bases, it is possible, using voltages and residence times conforming to practice, to produce oxide layers having a weight per unit area of, for example, only up to about 1.5 g/m$^2$, which corresponds to a layer thickness which of course provides less protection from mechanical abrasion than does a thicker oxide layer produced in an $H_2SO_4$ electrolyte. Because of the relatively large pore volume and pore diameter of an oxide layer produced in $H_3PO_4$, the mechanical stability of the oxide itself is lower, and this results in a further loss with respect to abrasion-resistance. There can also be problems of adhesion in certain negative-working layers, so that a printing plate base anodized in $H_3PO_4$ cannot be employed in all cases. The prior art oxide layers produced in an aqueous electrolyte containing $Na_3PO_4$ require, on the other hand, a treatment time which is too long for a modern high-speed manufacturing line and, by having a weight per unit area of up to only 200 $mg/m^2$, are furthermore unsuitable for protecting the fine pore structure of an electrochemically roughened aluminum surface sufficiently against mechanical abrasion. For this purpose, weights per unit area of more than 500 $mg/m^2$, in particular of more than 800 $mg/m^2$, are required for the high-performance printing plates demanded commercially today.

Processes have also been proposed which seek to combine the advantages of two different electrolytes by employing a two-stage treatment procedures; this also applies to the use of solutions containing phosphate ions in one of the two stages.

German Offenlegungsschift No. 32 06 470, which has not been previously published and has an earlier priority date, describes a two-stage oxidation process for the production of bases for offset printing plates, in which the anodic oxidation is carried out in (a) an aqueous electrolyte based on sulfuric acid and (b) an aqueous electrolyte containing phosphoroxo, phosphorfluoro and/or phosphoroxofluoro anions. A reversed sequence of the oxidation stages is described in a patent application filed concurrently herewith and corresponding to German patent application No. P 33 28 048 and entitled "Process for the Two-Stage Anodic Oxidation of Aluminum Bases for Offset Printing Plates." These two-stage oxidation processes can result in bases, for offset printing plates, which are usable and good in practice and which have the same or similar alkali resistance of an oxide produced in the $H_3PO_4$-containing aqueous electrolytes. However, the bases still require more expensive apparatus since anodic oxidation must be carried out in two baths, frequently also with the intermediate use of a rinsing bath. Such a plant then requires additional units and monitoring procedures, as a result of which, inter alia, additional sources of error can arise.

SUMMARY OF THE INVENTION

It is therefore an object of the present invention to propose a process for the anodic oxidation of bases for offset printing plates based on roughened and anodically oxidized aluminum, which can be carried out relatively rapidly and without great expenditure on apparatus and process technology in a modern manufacturing line.

Another object of the present invention is to provide a process of the type described above which produces bases which are distinguished by increased resistance to alkaline media and by very good mechanical stability.

Yet another object of the present invention is to provide a process as described above in which the anodic oxidation is performed in one stage.

In accomplishing the foregoing objects, there has been provided according to one aspect of the present invention a process for the production of bases for offset printing plates in the form of sheets, foils or webs from roughened aluminum or one of its alloys by means of a one-stage anodic oxidation in an aqueous electrolyte comprising phosphorus-containing anions, comprising the steps of mechanically, chemically and/or electrochemically roughening a base material comprising aluminum or its alloys, anodically oxidizing the roughened base material in an aqueous $H_3PO_4$-free electrolyte comprising dissolved phosphoroxo anions for a period of about 1 to 90 sec, at a voltage between about 10 and 100 V and at a temperature of about 10° to 80° C.

In a preferred embodiment, the anodic oxidation step is carried out for a period of about 5 to 70 sec, at a voltage between about 20 to 80 V and at a temperature of about 15° to 70° C., most preferably, for a period of about 10 to 60 sec, at a voltage between about 30 and 60 V and at a temperature of about 25° to 60° C.

In accordance with another aspect of the present invention, there has been provided a base for offset printing plates in the form of a sheet, a foil or a web produced by the process described above.

In accordance with another aspect of the present invention, there has been provided an offset printing plate, comprising a base material produced by the process described above, and a radiation-sensitive or photosensitive coating applied to the base material.

Further objects, features and advantages of the present invention will become apparent from the detailed description of preferred embodiments which follows.

DETAILED DESCRIPTION OF PREFERRED EMBODIMENTS

The present invention concerns a process for the production of bases for offset printing plates in the form of sheets, foils or webs from roughened aluminum or one of its alloys by means of a one-stage anodic oxidation in an aqueous electrolyte comprising phosphorus-containing anions. In the process according to the invention, the aluminum is first roughened, mechanically, chemically and/or electrochemically and then anodically oxidized (stage a) in an aqueous electrolyte other than $H_3PO_4$ comprising dissolved phosphoroxo anions for a period of about 1 to 90 sec, at a voltage between about 10 to 100 V and at a temperature of about 10° to 80° C.

In a preferred embodiment of the process according to the invention, stage (a) is carried out for a period of about 5 to 70 sec, at a voltage between about 20 and 80 V and at a temperature of about 15° to 70° C., especially about 10 to 60 sec, about 30 to 60 V and about 25° to 60° C.

The aqueous electrolyte with the stated content of phosphoroxo anions preferably comprises a salt possessing the corresponding anion, in particular a salt possessing an alkali metal, alkaline earth metal or ammonium cation and a phosphoroxo anion; however, it is also possible to employ acids, preferably oligo- and polyphosphoric acids. The concentration of the aqueous electrolyte can be varied within a wide range without variance in effect. Preferably the concentration ranges between about 20 g/l and the particular saturation limit of the salt at the given temperature, in general a concentration of more than 500 g/l does not yield any advantages. Examples of suitable electrolyte compounds include:

sodium dihydrogen phosphate, $NaH_2PO_4$
disodium hydrogen phosphate, $Na_2HPO_4$
trisodium phosphate, $Na_3PO_4$
phosphorous acid, $H_3PO_3$
sodium hihydrogen phosphite, $NaH_2PO_3$ disodium phosphite, $Na_2HPO_3$
diphosphoric acid (pyrophosphoric acid), $H_4P_2O_7$
sodium pyrophosphate, $Na_4P_2O_7$
triphosphoric acid, $H_5P_3O_{10}$
sodium triphosphate, $Na_5P_3O_{10}$
polyphosphoric acid, $H_{n+2}P_nO_{3n+1}$
hexasodium tetrapolyphosphate, $Na_6P_4O_{13}$
hexasodium metaphosphate, $Na_6(PO_3)_6$
metaphosphoric acid, $H_n(PO_3)_n$ As used herein, the term "phosphoroxo anion" is intended to refer to anions comprising one or more atoms of phophorus bonded to oxygen atoms as in the foregoing example compounds.

Similarly, the corresponding ammonium salts and, in particular, potassium salts can be used.

A preferred embodiment of the anodization process according to the present invention employs a solution of trisodium phosphate ($Na_3PO_4$) or a tripotassium phosphate ($K_3PO_4$) in fully de-ionized water as the electrolyte.

The weight per unit area of the oxide layer which is to be attained by the process according to the present invention increases with increasing electrolyte concentration and increasing voltage. While weights per unit area of the oxide layer up to about 1 g/m$^2$ can be achieved at electrolyte concentrations of less than about 60 g/l, at voltages up to about 60 V and for residence times up to about 90 sec, higher electrolyte concentrations surprisingly give weights per unit area of the oxide layer which are even greater than about 3 g/m$^2$. The highest growth of the oxide layer when the stated phosphoroxo anions are used is achieved, as a rule, with $K_3PO_4$ or $Na_3PO_4$. Surprisingly, the oxide layer thicknesses which can be achieved in this electrolyte can all be in the range of an oxide produced in an $H_2So_4$-containing electrolyte. The stated effect of the concentration of the electrolyte on the weight per unit area of the oxide layer which can be achieved cannot be determined when $H_3PO_4$ is used in a concentration greater than 100 g/l, this being in contrast to the electrolytes used according to the present invention.

An unexpected effect on the growth of the oxide layer is also observed when an acid containing phosphoroxo anions is replaced with a corresponding salt solution. In the series of electrolytes stated above, higher weights per unit area of the oxide layer are achieved, as a rule, using the salts of the acids containing phosphoroxo anions.

The current-time curves for the anodization in the various electrolytes employed according to the present invention show that the current flow remains constant over the period only when $Na_3PO_4$ or $K_3PO_4$ is used. This means that, when $Na_3PO_4$ or $K_3PO_4$ is used in an aqueous electrolyte for anodization, the growth of the oxide layer is dependent on the anodization time. However, in the case of long anodization times, it is also necessary to take into account the fact that the oxide may re-dissolve in the anodization electrolyte. In most of the other electrolytes investigated, with the exception of $H_3PO_4$ (not claimed), and $H_3PO_3$, the current falls from high initial values to values of less than about 1 to 2 A/dm$^2$ in the course of about 10 to 30 sec (depending on the electrolyte) at a given voltage. As a result, relatively long anodization times play only a very minor role in producing a further increase in the weight per unit area of the oxide layer.

In contrast to the weight per unit area of the oxide layer, the alkali-resistance (measured in the zincate test) of the oxide is no longer significantly depending on the concentration of the electrolyte for concentrations greater than about 60 g/l. After the maximum zincate test time has been reached at a concentration between about 60 and 100 g/l of, for example, $Na_3PO_4$, the further increase in the concentration of the electrolyte does not result in an increase in the zincate test time. In fact, a slight decrease is observed at high voltage. At a given concentration and voltage, the anodization time likewise has only a minor effect on the alkali-resistance of the oxide.

The principal factor affecting the alkali-resistance is the applied anodization voltage. The increase in the zincate test times runs parallel with the increase in the voltage.

Suitable base materials to be oxidized according to the invention include those comprising aluminum or one of its alloys which includes, for example, more than 98.5% by weight of Al and proportions of Si, Fe, Ti, Cu and Zn. These aluminum base materials are first cleaned, if necessary, and then roughened mechanically (for example, by brushing and/or by treatment with abrasives), chemically (for example, by means of etching agents) and/or electrochemically (for example, by treatment with a.c. current in aqueous HCl, $HNO_3$ or salt solutions). All process stages can be carried out batchwise, but are preferably carried out continuously.

In general, the process parameters in the roughening stage are in the following ranges, particularly in the case of the continuous procedure: the temperature of the electrolyte is between about 20° and 60° C., the active compound (acid or salt) concentration is between about 2 and 100 g/l (or higher in the case of salts), the current density is between about 15 and 250 A/dm$^2$, the residence time is between about 3 and 100 sec and the flow rate of the electrolyte at the surface of the article to be treated is between about 5 and 100 cm/sec. The type of current used is generally a.c. current; however, it is also possible to employ modified types of current, such as a.c. current with different current amplitudes for the anode current and cathode current. In this procedure, the average peak-to-valley height $R_z$ of the roughened surface is in the range from about 1 to 15 μm. The peak-to-valley height is determined in accordance with DIN 4768 in the version of October 1970, and the average peak-to-valley height $R_z$ is then the arithmetic mean of the individual peak-to-valley heights of five individually measured areas lying adjacent to one another.

The precleaning step comprises, for example, treatment with aqueous NaOH solution, with or without degreasing agents and/or complex formers, trichloroethylene, acetone, methanol or other commercial, so-called aluminum pickles.

The roughening step can be followed by an additional etching treatment whereby, in particular, a maximum of 2 g/m$^2$ is removed. If there are several roughening stages, etching treatment can also be carried out between the individual stages, with up to 5 g/m$^2$ being removed between the stages. The etching solutions used are in general aqueous alkali metal hydroxide solutions or aqueous solutions of alkaline salts or aqueous acid solutions based on $HNO_3$, $H_2SO_4$ or $H_3PO_4$. In addition to an etching treatment stage between the roughening stage and the anodization stage, non-electrochemical treatments are also known which merely have a rinsing and/or cleaning action and are useful, for example, for removing deposits ("smut") formed during the roughening process or simply for removing residual electrolyte. For example, dilute aqueous alkali metal hydroxide solutions or water are used for these purposes.

The anodic oxidation of the aluminum base material can also be followed by one or more post-treatment stages, although these are often unnecessary, particularly in the present process. Post-treatment is understood as meaning, in particular, a chemical or electrochemical treatment of the aluminum oxide layer to render it hydrophilic, for example, treatment of the material by immersion in an aqueous polyvinylphosphonic acid solution in accordance with British Pat. No. 1,230,447, treatment by immersion in an aqueous alkali metal silicate solution in accordance with U.S. Pat. No. 3,181,461 or an electrochemical treatment (anodization) in an aqueous alkali metal silicate solution in accordance with U.S. Pat. No. 3,902,976. In these post-treatment stages, in particular, the hydrophilicity of the aluminum oxide layer, which is frequently already sufficient, is increased further while retaining the remaining conventional properties of this layer being at least retained.

The materials produced according to the present invention are used as bases for offset printing plates, i.e., a radiation-sensitive coating is applied on one or both sides of the base material, either by the manufacturer of presensitized printing plates or directly by the user. Suitable radiation-sensitive or photosensitive layers are, in principle, all layers which, after irradiation (exposure) and with or without subsequent development and/or fixing, give an imgewise surface which can be used for printing.

In addition to the silver halide-containing layers used in many fields, various other layers are also known, as described in, for example "Light-Sensitive Systems" by Jaromir Kosar, published by John Wiley & Sons, New York 1965: colloid layers containing chromates and dichromates (Kosar, chapter 2); layers containing unsaturated compounds which undergo isomerization, rearrangement, cyclization or crosslinking on exposure (Kosar, chapter 4); layers containing photopolymerizable compounds and in which monomers or prepolymers undergo polymerization on exposure, if appropriate with the aid of an initiator (Kosar, chapter 5); and layers containing o-diazoquinones, such as diazonaphthoquinones, p-diazoquinones or diazonium salt condensates (Kosar, chapter 7). Suitable layers also include the electrophotographic layers, i.e., those which contain an inorganic or organic photoconductor. In addition to the photosensitive substances, these layers can, of course, also contain other components, such as, for example, resins, dyes or plasticizers. In particular, the following photosensitive compositions or compounds can be employed in coating the bases produced by the process according to the present invention:

positive-working reproduction layers which are described in, for example, German Pat. No. 854,890; No. 865,109; No. 879,203; No. 894,959; No. 938,233; No. 1,109,521; No. 1,144,705; No. 1,118,606; No. 1,120,273; No. 1,124,817 and No. 2,331,377 and European Patent Applications No. 0,021,428 and No. 0,055,814, and which contain, as the photosensitive compound, o-diazoquinones, in particular o-diazonaphthoquinones, such as 2-diazo-1, 2-naphthoquinonesulfonic acid esters or amides, which can be of low molecular weight or high molecular weight;

negative-working reproduction layers containing condensation products of aromatic diazonium salts and compounds possessing active carbonyl groups, preferably condensation products of diphenylaminediazonium salts and formaldehyde, which are described in, for example, German Pat. No. 596,731; No. 1,138,399; No. 1,138,400; No. 1,138,401; No. 1,142,871 and No. 1,154,123 U.S. Pat. No. 2,679,498 and No. 3,050,502 and British Pat. No. 712,606;

negative-working reproduction layers, for example as described in German Pat. No. 20 65 732, which contain co-condensation products of aromatic diazonium compounds, the layers containing products which contain at least one unit each of (a) a condensable aromatic diazonium salt compound and (b) a condensable compound such as a phenol ether or an aromatic thioether, bonded through a divalent bridge member, such as a methylene group, which is derived from a condensable carbonyl compound;

positive-working layers as described in German Offenlegungsschift No. 26 10 842, German Pat. No. 27 18 254 or German Offenlegungsschrift No. 29 28 636, which contain a compound which splits off acid on exposure, a monomeric or polymeric compound which possesses at least one C-O-C group which can be split off by means of an acid (for example an orthocarboxylate group or a carboxamidoacetal group), and, if appropriate, a binder;

negative-working layers consisting of photopolymerizable monomers, photoinitiators, binders and, if appropriate, further additives; the monomers used are, for example, acrylates and methacrylates or reaction products of di-isocyanates with partial esters of polyhydric alcohols, as described in, for example, U.S. Pat. No. 2,760,863 and No. 3,060,023 and German Offenlegungsschriften No. 20 64 079 and No. 23 61 041; and negative-working layers as described in German Offenlegungsschrift No. 30 36 077, which contain, as the photosensitive compound, a diazonium salt polycondensation product or an organic azido compound and, as the binder, a high molecular weight polymer possessing alkenylsulfonyl or cycloalkenylsulfonylurethane side groups.

Photosemiconducting layers as described in, for example, German Pat. No. 11 17 391, No. 15 22 497, No. 15 72 312, No. 23 22 046 and No. 23 22 047 can also be applied onto the bases produced according to the invention, to produce highly photosensitive electrophotographic printing plates.

The coated offset printing plates obtained from the bases produced by the process according to the present invention are converted to the desired printing form in a known manner, by imagewise exposure or irradiation and washing out of the non-image areas with a developer, for example an aqueous alkaline developer solution.

The one-stage process according to the invention combines, inter alia, the following advantages:

The alkali-resistance of the oxide produced is substantially superior to that of the oxide produced in an $H_2SO_4$-containing aqueous electrolyte, and markedly superior to that of the oxide produced in an $H_3PO_4$-containing aqueous electrolyte.

The resulting weight per unit area of the oxide layer reaches the values of the oxide layer produced in an $H_2SO_4$-containing electrolyte, and, with respect to the layer thickness, is hence far superior to the oxide produced in $H_3PO_4$-containing electrolytes.

The oxide layer is very hydrophilic, so that it may be possible to dispense with one of the post-treatment steps for hydrophilization which are conventionally used in printing plate production technology.

The bases can be used for all positive-working, negative-working and electrophotographically-working reproduction layers.

In the above description and the examples below, percentages denote percentages by weight, unless stated otherwise. Parts by weight bear the same relation to parts by volume as that of g to $cm^3$. Otherwise, the following methods have been used in the examples in order to test the alkali-resistance of the surface, and the results of the particular examples have been summarized in tables.

Zincate test (according to U.S. Pat. No. 3,940,321, columns 3 and 4, lines 29 to 68 and lines 1 to 8, the disclosure of which is herein incorporated by reference):

The rate of dissolution, is sec, of an aluminum oxide layer in an alkaline zincate solution is taken as a measure of the alkali-resistance of the layer. The longer the layer requires for dissolution, the greater is its resistance to alkalis. The layer thicknesses should be roughly comparable, since of course they also constitute a parameter with regard to the dissolution rate. A drop of a solution of 480 g of KOH and 80 g of zinc oxide in 500 ml of distilled water is applied to the surface to be investigated, and the time which elapses before the appearance of metallic zinc is determined, this being recognizable from the dark coloration which appears at the point being investigated.

Gravimetrically determined corrosion rate

A sample of defined size which is protected on the reverse side by means of a surface coating film is agitated in a bath which contains an aqueous solution containing 6 g/l of NaOH. The weight loss suffered in this bath is determined gravimetrically. Times of 1, 2, 4 or 8 minutes are chosen as treatment times in the alkaline bath.

Comparative Example V1

A mill-finished aluminum sheet which is 0.3 mm thick is degreased using an aqueous alkaline pickling solution at a temperature of 50° to 70° C. Electrochemical roughening of the aluminum surface is carried out using a.c. current in an $HNO_3$-containing electrolyte, and a surface roughness having an $R_z$ value of about 6 μm is obtained. Subsequent anodic oxidation is carried out in accordance with the process described in European Patent No. 0,004,569, in an aqueous electrolyte containing $H_2SO_4$ and $Al_2(SO_4)_3$, this procedure leading to a weight per unit area of the oxide layer of 2.8 $g/m^2$.

Comparative Example V2

An aluminum web which has been roughened as described in Comparative Example V1 is oxidized anodically in an aqueous electrolyte containing 100 g/l of $H_3PO_4$, at a voltage of 40 V in the course of 40 sec. The resulting weight per unit area of the oxide layer is 0.9 $g/m^2$.

Examples 1 to 40

An aluminum web roughened electrochemically as described in Comparative Example V1 is rinsed with fully de-ionized water and then subjected to anodic oxidation in the aqueous electrolytes listed in Table I, and under the conditions likewise stated in that Table. Table I also shows the results of the determinations of the weight per unit area of the oxide layer, and the zincate test times as a measure of the alkali-resistance. Table II contains comparative data for determining alkali-resistance by means of the gravimetrically determined corrosion rate in NaOH solution.

TABLE I

| Example | Electrolyte Solution Contains | Concentration of the Electrolyte (g/l) | Voltage (V) | Time (sec) | Weight Per Unit Area of Oxide Layer ($g/m^2$) | Zincate Test (sec) |
|---|---|---|---|---|---|---|
| V1 | $H_2SO_4/Al^{3+}$ | 200/7 | 25 | 40 | 3.0 | 27 |
| V2 | $H_3PO_4$ | 100 | 40 | 40 | 0.8 | 121 |
| 1 | $Na_3PO_4$ | 20 | 40 | 60 | 0.5 | 138 |
| 2 | $Na_3PO_4$ | 40 | 40 | 60 | 0.8 | 153 |
| 3 | $Na_3PO_4$ | 60 | 40 | 40 | 0.7 | 195 |
| 4 | $Na_3PO_4$ | 80 | 20 | 60 | 0.7 | 117 |
| 5 | $Na_3PO_4$ | 80 | 40 | 60 | 1.1 | 231 |
| 6 | $Na_3PO_4$ | 80 | 60 | 40 | 1.4 | 312 |
| 7 | $Na_3PO_4$ | 80 | 60 | 60 | 1.6 | 292 |
| 8 | $Na_3PO_4$ | 100 | 20 | 60 | 0.8 | 116 |
| 9 | $Na_3PO_4$ | 100 | 40 | 40 | 0.9 | 217 |
| 10 | $Na_3PO_4$ | 100 | 40 | 60 | 1.2 | 224 |
| 11 | $Na_3PO_4$ | 100 | 60 | 40 | 1.7 | 332 |
| 12 | $Na_3PO_4$ | 100 | 60 | 60 | 1.9 | 352 |
| 13 | $Na_3PO_4$ | 150 | 20 | 60 | 1.0 | 129 |
| 14 | $Na_3PO_4$ | 150 | 40 | 40 | 1.3 | 218 |
| 15 | $Na_3PO_4$ | 150 | 40 | 60 | 2.2 | 209 |
| 16 | $Na_3PO_4$ | 150 | 60 | 20 | 1.3 | 267 |
| 17 | $Na_3PO_4$ | 150 | 60 | 40 | 2.3 | 289 |
| 18 | $Na_3PO_4$ | 150 | 60 | 60 | 2.6 | 311 |
| 19 | $Na_3PO_4$ | 200 | 20 | 60 | 1.0 | 126 |
| 20 | $Na_3PO_4$ | 200 | 40 | 40 | 1.7 | 200 |
| 21 | $K_3PO_4$ | 100 | 60 | 60 | 2.9 | 249 |
| 22 | $K_3PO_4$ | 150 | 40 | 30 | 1.4 | 173 |
| 23 | $K_3PO_4$ | 200 | 40 | 30 | 2.6 | 154 |
| 24 | $(NH_4)_3PO_4$ | 100 | 60 | 60 | 1.2 | 132 |
| 25 | $(NH_4)_3PO_4$ | 150 | 60 | 60 | 1.4 | 139 |
| 26 | $NaH_2PO_4$ | 40 | 60 | 60 | 0.7 | 149 |
| 27 | $NaH_2PO_4$ | 100 | 80 | 40 | 1.1 | 157 |
| 28 | $NaH_2PO_4$ | 150 | 80 | 40 | 1.3 | 178 |
| 29 | $H_4P_2O_7$ | 100 | 60 | 60 | 0.5 | 74 |
| 30 | $Na_4P_2O_7$ | 100 | 60 | 60 | 0.6 | 117 |
| 31 | $H_4(PO_3)_n$ | 100 | 60 | 60 | 1.1 | 68 |
| 32 | $Na_6(PO_3)_6$ | 100 | 60 | 60 | 1.3 | 104 |
| 33 | $Na_6P_4O_{13}$ | 100 | 60 | 60 | 1.5 | 138 |
| 34 | $Na_4P_2O_7$ | 200 | 60 | 60 | 1.2 | 137 |
| 35 | $Na_5P_3O_{10}$ | 200 | 60 | 60 | 1.3 | 143 |
| 36 | $Na_6P_4O_{13}$ | 200 | 60 | 60 | 1.7 | 152 |
| 37 | $Na_6(PO_3)_6$ | 200 | 60 | 60 | 1.5 | 126 |
| 38+ | $Na_3PO_4$ | 100 | 40 | 40 | 1.32 | 233 |
| 39+ | $Na_3PO_4$ | 150 | 40 | 40 | 2.54 | 217 |
| 40+ | $Na_3PO_4$ | 200 | 40 | 40 | 2.78 | 185 |

+Samples 38 to 40 oxidized anodically at 60° C.
All other examples are prepared at 40° C.

TABLE II

| Example | Residence Time (min) for the gravimetrically determined corrosion rate | | | | | |
|---|---|---|---|---|---|---|
| | 1 | 2 | 4 | 6 | 8 | 10 |
| V1 | 1.21 | 2.23 | 3.42 | 4.85 | 6.53 | 8.38 |
| V2 | 0.34 | 0.86 | 1.45 | 2.87 | 4.38 | 6.41 |
| 6 | 0.05 | 0.10 | 0.32 | 0.59 | 0.82 | 1.43 |
| 11 | 0.05 | 0.10 | 0.29 | 0.49 | 0.76 | 1.32 |
| 15 | 0.07 | 0.13 | 0.36 | 0.64 | 0.98 | 1.69 |
| 20 | 0.08 | 0.17 | 0.38 | 0.73 | 1.21 | 1.87 |
| 24 | 0.09 | 0.19 | 0.43 | 0.87 | 1.35 | 2.28 |
| 27 | 0.12 | 0.25 | 0.53 | 0.94 | 1.83 | 3.53 |

TABLE II-continued

| Example | Residence Time (min) for the gravimetrically determined corrosion rate | | | | | |
|---|---|---|---|---|---|---|
| | 1 | 2 | 4 | 6 | 8 | 10 |
| 30 | 0.15 | 0.29 | 0.65 | 1.62 | 2.87 | 4.94 |
| 33 | 0.13 | 0.27 | 0.61 | 0.99 | 1.73 | 3.16 |

Example 41

An aluminum substrate prepared as described in Example 8 is provided with the following negative-working photosensitive layer:

0.70 part by weight of a polycondensation product of 1 mole of 3-methoxydiphenylamine-4diazonium sulfate and 1 mole of 4,4'-bismethoxymethyldiphenyl ether, precipitated as mesitylenesulfonate;
3.40 parts by weight of 85% strength phosphoric acid;
3.00 parts by weight of a modified epoxy resin obtained by reacting 50 parts by weight of an epoxy resin having a molecular weight of less than 1,000 and 12.8 parts by weight of benzoic acid in ethylene glycol monomethyl ether in the presence of benzyltrimethylammonium hydroxide;
0.44 part by weight of finely milled Heliogen blue G (C.I. 74 100);
62.00 parts by volume of ethylene glycol monomethyl ether;
30.60 parts by volume of tetrahydrofuran; and
8.00 parts by volume of butyl acetate.

Following exposure through a negative mask, development is carried out using a solution of 2.80 parts by weight of $Na_2SO_4.10H_2O$,
2.80 parts by weight of $MgSO_4.7H_2O$,
0.90 part by weight of 85% strength phosphoric acid,
0.08 part by weight of phosphorous acid,
1.60 parts by weight of a non-ionic wetting agent,
10.00 parts by weight of benzyl alcohol,
20.00 parts by weight of n-propanol, and
60.00 parts by weight of water.

The printing plate produced in this manner can be developed rapidly and without staining. The print run obtained using a printing form produced in this manner is 170,000. A base which is produced as described in Comparative Example VI and which is quoted with the same formulation can only be developed under more severe conditions. After development, yellow fogging, which may be caused by adhering particles of diazonium compound, may remain in the non-image areas. If a base according to Comparative Example V2 is used, it is found that, during printing, substantial gloss occurs in the non-image area after about 90,000 prints, this gloss increases with the length of the print run. After 120,000 prints, the print quality has deteriorated to a level which is no longer acceptable in practice.

Example 42

An aluminium substrate produced as described in Example 11 is coated with the following positive-working photosensitive solution:

6.00 parts by weight of cresol-formaldehyde novolak (having a softening range from 105° to 120° C. according to DIN 53 181),
1.10 parts by weight of 4-(2-phenylprop-2-yl)-phenyl 2-diazo-1,2-naphthoquinone-4-sulfonate,
0.81 part by weight of polyvinylbutyral,
0.75 part by weight of 2-diazo-1,2-naphthoquinone-4-sulfonyl chloride,
0.08 part by weight of crystal violet, and
91.36 parts by weight of a solvent mixture comprising 4 parts by volume of ethylene glycol monomethyl ether, 5 parts by volume of tetrahydrofuran and 1 part by volume of butyl acetate.

The coated web is dried in a drying tunnel at temperatures up to 120° C. The printing plate produced in this manner is exposed through a photographic positive and developed with a developer of the following composition:

5.30 parts by weight of sodium metasilicate.9 $H_2O$,
3.40 parts by weight of trisodium phosphate.12 $H_2O$,
0.30 parts by weight of sodium dihydrogen phosphate (anhydrous) and
91.00 parts by weight of water.

The printing form obtained has satisfactory copying and printing properties and possesses very good contrast after exposure. The print run is 150,000.

A corresponding plate produced from the base material of Comparative Example VI shows blue fogging in the non-image areas. After the developer has been acting for a fairly long time, the non-image areas display a substantial light-dark shadow effect, which is an indication of attack on the oxide by the developer solution.

Example 43

An aluminum substrate prepared as described in Example 14 is provided with the following negative-working photosensitive layer:

16.75 parts by weight of an 8.0% strength solution of the reaction product of a polyvinylbutyral having a molecular weight of 70,000 to 80,000 consisting of 71% by weight of vinylbutyral units, 2% by weight of vinylacetate units and 27% by weight of vinyl alcohol units, with propylenesulfonyl isocyanate,
2.14 parts by weight of 2,6-bis-(4-azido-benzene)-4-methyl-cyclohexanone,
0.23 part by weight of RHODAMINE6 GDN extra and
0.21 part by weight of 2-benzoylmethylene-1-methyl-β-naphthothiazine in
100 parts by weight of ethylene glycol monomethyl ether, and
50 parts by weight of tetrahydrofuran.

The weight per unit area of the dry layer is 0.75 g/m$^2$. The copying layer is exposed to a 5 kW metal halide lamp through a photographic negative for 35 seconds. The exposed layer is treated, by means of a pad, with a developer solution having the composition:

5 parts by weight of sodium lauryl sulfate,
1 part by weight of sodium metasilicate.5 $H_2O$, and
94 parts by weight of water,
the non-image area being removed.

In a printing press, the plate gives a print run of 170,000. When the base produced as described in Comparative Example V2 is used, substantially reduced adhesion of the copying layer is found.

Example 44

A base oxidized anodically as described in Example 26 is coated with the following solution to produce an electrophotographically working offset printing plate:

10.00 parts by weight of 2,5-bis-(4'-diethylamino-phenyl)-1,3,4,-oxdiazole, 10,00 parts by weight of a copolymer of styrene and maleic anhydride, having a softening point of 210° C.

0.02 part by weight of rhodamine FB (C. I. 45 170) and 300.00 parts by weight of ethylene glycol monomethyl ether.

The layer is negatively charged to about 400 V in the dark by means of a corona. The charged plate is exposed imagewise in a process camera and then developed with an electrophotographic suspension developer which comprises a dispersion of 3.0 parts by weight of magnesium sulfate in a solution of 7.5 parts by weight of pentaerythritol resin ester in 1200 parts by volume of an isoparaffin mixture having a boiling range from 185° to 210° C. After the excess developer liquid has been removed, the developer is fixed and the plate is immersed for 60 sec in a solution comprising 35 parts by weight of sodium metasilicate.9 $H_2O$, 140 parts by weight of glycerol, 550 parts by weight of ethylene glycol and 140 parts by weight of ethanol.

The plate is then rinsed with a strong jet of water, those areas of the photoconductor layer which are not covered with toner being removed; the plate is then ready for printing.

Example 45

An aluminum web prepared as described in Example 12 is subjected to a further treatment step (additionl hydrophilization) by being immersed for 20 sec in a 0.2% strength aqueous solution of polyvinylphosphonic acid at 50° C. After drying, the base additionally hydrophilized in this manner is processed further as described in Example 3, and the ink-repellent action of the non-image areas can be improved. Hydrophilization which is still more advantageous is achieved using the complex-type reaction products described in German Offenlegungsschrift No. 31 26 636, which comprise (a) polymers such as polyvinylphosphonic acid and (b) a salt of a metal cation which is at least divalent.

The foregoing description has been set forth merely to illustrate the invention and is not intended to be limiting. Since modifications of the described embodiments incorporating the spirit and substance of the invention may occur to persons skilled in the art, the scope of the invention is to be limited solely with respect to the appended claims and equivalents.

What is claimed is:

1. A process for producing a base for an offset printing plate comprising the steps of:

subjecting a base material selected from aluminum and aluminum alloys to an electrochemical roughening treatment in an acid to produce a roughened base material, and anodically oxidizing said roughened base material in a single stage in an aqueous $H_3PO_4$-free electrolyte comprising dissolved inorganic phosphoroxo-anions of inorganic phosphoroxo compounds selected from the group consisting of metaphosphoric, pyrophosphoric or polyphosphoric acids or alkali metal or alpaline earth metal or ammonium salts of orthophosphoric, metaphosphoric, pyrophosphoric or polyphosphoric acids for a period from about 1 to about 90 seconds, at a voltage from 20 to about 100 volts and at a temperature from about 10° to about 80° C. to produce a metal oxide layer having a weight per unit of at least 0.5 $g/m^2$.

2. The process as claimed in claim 1, wherein said anodic oxidation step is carried out for a period of about 5 to 70 seconds, at a voltage between about 20 and 80 volts and at a temperature of about 15° to 60° C.

3. The process as claimed in claim 1, wherein said anodic oxidation step is carried out for a period of about 10 to 60 seconds, at a voltage between about 30 and 60 volts and at a temperature of about 25° to 60° C.

4. The process as claimed in claim 1, wherein said aqueous electrolyte comprises a salt having a cation selected from alkali metal, alkaline earth metal and ammonium cations and a phosphoroxo anion.

5. The process as claimed in claim 1, wherein said aqueous electrolyte comprises trisodium phosphate or tripotassium phosphate in de-ionized water.

6. The process as claimed in claim 4, wherein said aqueous electrolyte comprises trisodium phosphate.

7. The process as claimed in claim 4, wherein said aqueous electrolyte comprises tripotassium phosphate.

8. The process as claimed in claim 1, wherein said aqueous electrolyte comprises a phosphoroxo compound in an amount from about 20 g/l to saturation.

9. The process as claimed in claim 1, further comprising the step of hydrophilizing said anodically oxidized base material.

10. The process as claimed in claim 1, wherein said aqueous electrolyte comprises an acid having said dissolved phosphoroxo anions.

11. The process as claimed in claim 10, wherein said acid is selected from oligo- and polyphosphoric acids.

12. A base for offset printing plates in the form of a sheet, a foil or a web, produced by the process of claim 1.

13. An offset printing plate, comprising:

a base material produced by the process of claim 1, and a radiation-sensitive or photosensitive coating applied to said base material.

* * * * *

UNITED STATES PATENT AND TRADEMARK OFFICE

CERTIFICATE OF CORRECTION

PATENT NO. : 4,604,341

DATED : August 5, 1986

INVENTOR(S) : Dieter MOHR

It is certified that error appears in the above-identified patent and that said Letters Patent is hereby corrected as shown below:

COLUMN 14, Line 9, "alpaline" should read --alkaline--;
Line 15, "unit" should read --unit area--.

Signed and Sealed this

Twenty-seventh Day of January, 1987

*Attest:*

DONALD J. QUIGG

*Attesting Officer* *Commissioner of Patents and Trademarks*